US005937755A

United States Patent [19]

Preuss et al.

[11] Patent Number: 5,937,755

[45] Date of Patent: Aug. 17, 1999

[54] APPARATUS FOR SETTING PRINTING PRESSURE OF ECCENTRICALLY JOURNALED CYLINDERS

[75] Inventors: Karl Preuss; Hans-Jürgen Zelfel, both of Würzburg, Germany

[73] Assignee: KBA-Planeta AG, Germany

[21] Appl. No.: 09/078,060

[22] Filed: May 12, 1998

[30] Foreign Application Priority Data

May 14, 1997 [DE] Germany ..... 197 20 073

[51] Int. Cl.[6] ..... B41F 5/22; B41F 13/20; B41F 13/28

[52] U.S. Cl. ..... 101/218

[58] Field of Search ..... 101/217, 218, 101/177, 137, 139, 140, 142, 143, 144, 145, 247

[56] References Cited

U.S. PATENT DOCUMENTS 3,046,881 7/1962 Jurny ..... 101/218
4,183,297 1/1980 Skiera ..... 101/218

FOREIGN PATENT DOCUMENTS

OS 4142755 6/1993 Germany .

*Primary Examiner*—J. Reed Fisher
*Attorney, Agent, or Firm*—Schweitzer Cornman Gross & Bondell LLP

[57] ABSTRACT

The present invention is an apparatus for setting printing pressure in an offset printing press having an impression cylinder, an eccentrically journaled blanket cylinder, and an eccentrically journaled plate cylinder, each of the cylinders and each of the eccentric journals having an axis, wherein the printing pressure is to be adjusted between the blanket cylinder and the impression cylinder, as well as between the blanket cylinder and the plate cylinder, wherein a bearer ring to bearer ring contact exists between the blanket cylinder and the plate cylinder, wherein the impression cylinder, the blanket cylinder and the plate cylinder are in a basic printing position in which the axis of the plate cylinder, the axis of the eccentric journal of the blanket cylinder are disposed on a first straight-line, and the axis of the blanket cylinder is disposed on a second straight-line intersecting with the first straight-line at the axis of the eccentric journal of the blanket cylinder, at an adjustment angle between the intersecting first and the second straight-lines, and upon a change in the printing pressure between the blanket cylinder and the impression cylinder the blanket cylinder can be swung aside on its eccentric journal without a corresponding synchronous adjustment of the plate cylinder.

3 Claims, 2 Drawing Sheets

APPARATUS FOR SETTING PRINTING PRESSURE OF ECCENTRICALLY JOURNALED CYLINDERS

FIELD OF THE INVENTION

The invention relates to apparatus for setting printing pressure of eccentrically journaled cylinders, especially between blanket cylinder and impression cylinder as well as between blanket cylinder and plate cylinder, whereby suitably a bearer to bearer contact exists between blanket cylinder and plate cylinder.

BACKGROUND

It is generally customary to journal blanket cylinder and plate cylinder eccentrically to adjust the printing pressure. The printing pressure of the plate cylinder to blanket cylinder respectively of the blanket cylinder to the impression cylinder can be set by eccentric journals. To obtain this, the plate cylinder and blanket cylinder, which touches the impression cylinder in the basic printing position, are positioned so that the axes of the plate cylinder, the blanket cylinder and the eccentric blanket cylinder journal are positioned on one first straight-line. The axes of the plate cylinder and eccentric plate cylinder journal are on a second straight-line, which is perpendicular to the first straight-line.

The blanket cylinder is swiveled around the axis of the corresponding eccentric journal depending on the material thickness of the processed printing material, so that the blanket cylinder is moved away from the impression cylinder and the printing pressure between both cylinders is adjusted accordingly. This swiveling of blanket cylinder around the axis of the eccentric journal also causes a distancing of the blanket cylinder from the plate cylinder. Therefore the plate cylinder must be tracked to the blanket cylinder by rotating the plate cylinder around axis of the eccentric plate cylinder journal. This always assures the same distances between the axis of blanket cylinder and plate cylinder although the distance between blanket cylinder and impression cylinder is changed depending on the processed printing material.

For example, German patent No. 4,142,755 describes apparatus for the synchronous, simultaneous adjustment of the cylinders to each other by an adjustment drive for each plate cylinder and blanket cylinder and to couple both adjustment drives so that a simultaneous tracking of the plate cylinder to the blanket cylinder is made, depending on the position of the blanket cylinder relative to the printing cylinder. A disadvantage of that apparatus is the required cost of the drive system and of its manufacture.

SUMMARY DESCRIPTION OF INVENTION

It is an object of the present invention to provide an apparatus for setting printing pressure in an offset printing press having an impression cylinder, an eccentrically journaled blanket cylinder, and an eccentrically journaled plate cylinder, each of the cylinders and each of the eccentric journals having an axis, wherein the printing pressure is to be adjusted between the blanket cylinder and the impression cylinder, as well as between the blanket cylinder and the plate cylinder, wherein a bearer ring to bearer ring contact exists between the blanket cylinder and the plate cylinder, wherein the impression cylinder, the blanket cylinder and the plate cylinder are in a basic printing position in which the axis of the plate cylinder, the axis of the eccentric journal of the blanket cylinder are disposed on a first straight-line, and the axis of the blanket cylinder is disposed on a second straight-line intersecting with the first straight-line at the axis of the eccentric journal of the blanket cylinder, at an adjustment angle between the intersecting first and the second straight-lines, and upon a change in the printing pressure between the blanket cylinder and the impression cylinder the blanket cylinder can be swung aside on its eccentric journal without a corresponding synchronous adjustment of the plate cylinder.

A major advantage of the present invention is, that paper thickness adjustment can be carried out within a certain range without the necessity of tracking of the plate cylinder by only one of the usually required arrangements for the deviating position of the axes of the cylinders, respectively of the eccentric journals, and the application of maximum possible printing pressure between the plate cylinder and the blanket cylinder, respectively between the pertaining bearer rings of these cylinders.

BRIEF DESCRIPTION OF DRAWINGS

The invention is described below in greater detail by an embodiment of the invention, by reference being had to the drawing, wherein.

DETAILED DESCRIPTION

Figure 1:
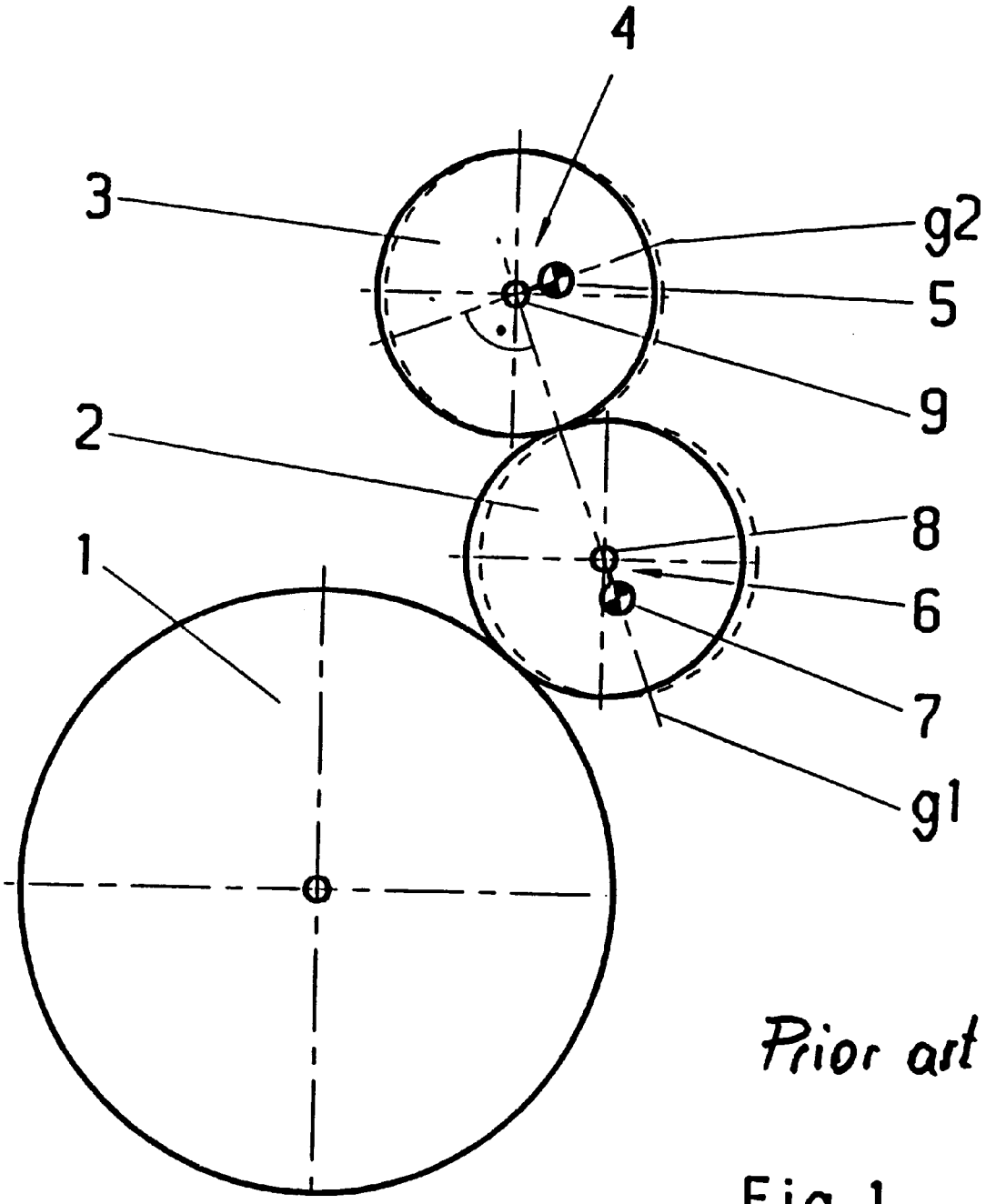
Prior art Fig. 1
FIG. 1 shows a cylinder arrangement of the prior art.

FIG. 1 shows an impression cylinder 1 with a blanket cylinder 2 and its axis 8 and a plate cylinder 3 with its axis 9 in the so-called basic printing position. In the basic printing position the blanket cylinder 2 is set to the impression cylinder 1 and the plate cylinder 3 to the blanket cylinder 2. The plate cylinder 3 is journaled in eccentric journals 4 with a axis 5 and the blanket cylinder 2 in eccentric journals 6 with a axis 7. According to the prior art the axis 8 of the blanket cylinder 2, the axis 7 of the eccentric journal 6 for the blanket cylinder 2 as well as the axis 9 of the plate cylinder 3 are on one common straight-line g1 and the axis 9 of the plate cylinder 3 and the axis 5 of the eccentric journal 4 are on one common straight-line g2, which is perpendicular to the straight-line g1. The blanket cylinder 2 is swiveled from the shown basic printing position in FIG. 1 (full lines) by clockwise rotation of the axis 8 of the blanket cylinder 2 around the axis 7 of the eccentric journal 6. Thereby the blanket cylinder 2 is also moved away from the plate cylinder 3, so that the plate cylinder must be tilted around the axis 5 of the eccentric journal 4 for tracking (dashed line).

Figure 2:
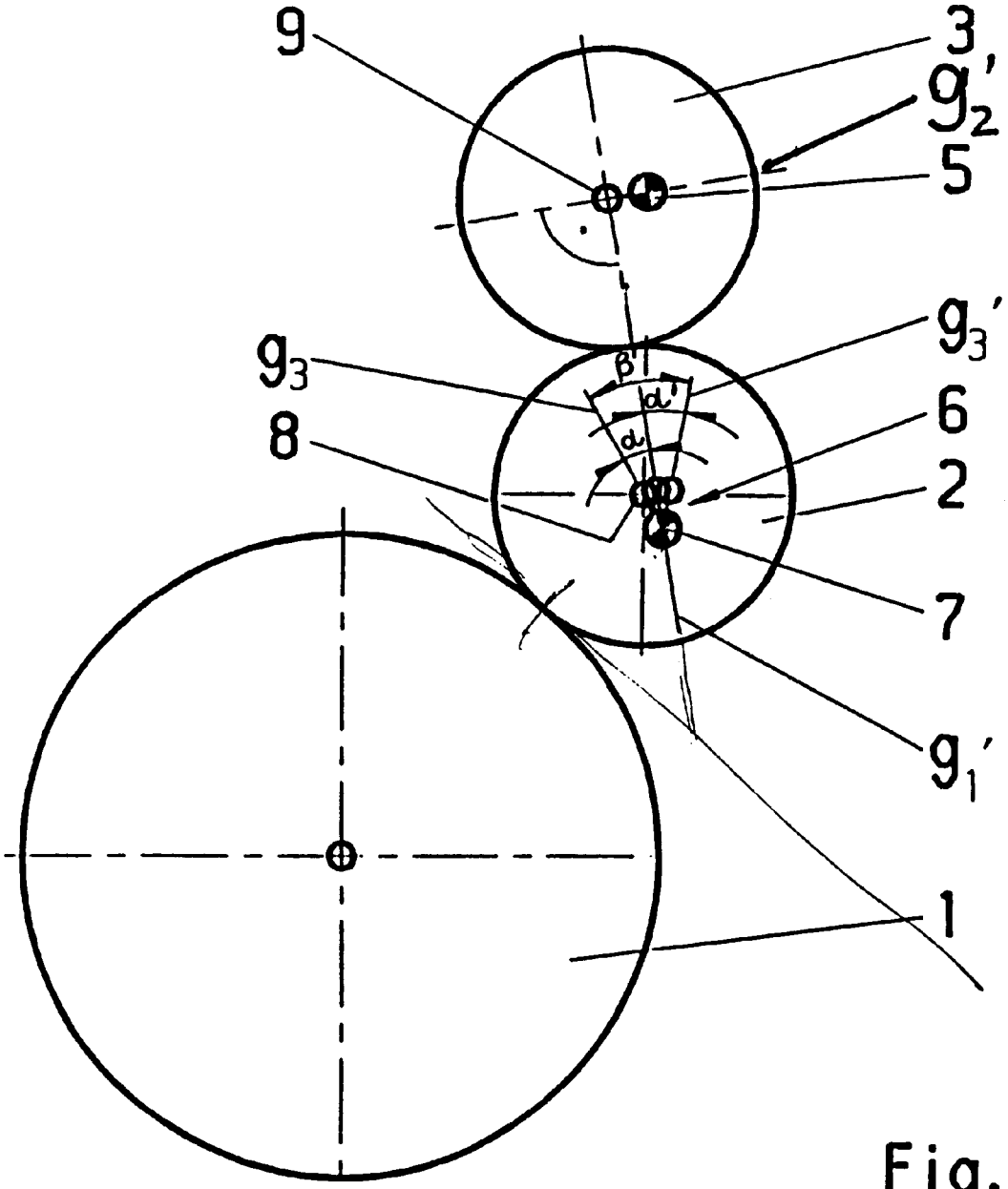
FIG. 2 shows the cylinder arrangement of the present invention.

FIG. 2 shows the impression cylinder 1, the blanket cylinder 2 and the plate cylinder 3 in the basic printing position for active connection of the cylinders 1, 2, and 3. In the basic printing position the axis 9 of the plate cylinder 3 and the axis 7 of the eccentric journal 6 for the blanket cylinder are on one common straight-line $g_1'$. Perpendicular to the straight-line $g_1'$ is the straight-line $g_2'$ through the axis 9 of the plate cylinder 3 and the axis 5 of the eccentric journal 5 for the plate cylinder 3. The axis 8 of the blanket cylinder 2 and the axis 7 of the eccentric journal 6, are both disposed on the straight-line $g_3$. The straight-line $g_3$ includes an angle with the straight-line $g_1'$ and extends in an angular range between $g_1'$ and the maximum pressure contact of the blanket cylinder with the impression cylinder.

The axis 8 of the blanket cylinder 2 is swiveled around the axis 7 of the eccentric journal 6 for paper thickness adjustment. It is possible to swivel the axis 8 of the blanket cylinder 2 and with that blanket cylinder 2 from the basic printing position clockwise by an adjustment angle $\alpha$, without changing the position of the plate cylinder 3, so that the axis 8 is on the straight-line $g_1'$. The printing pressure between plate cylinder 3 and blanket cylinder 2 is increased with that, or respectively by using bearer ring to bearer ring contact from a minimal value for the basic printing position to a maximum permissible value. The adjustment angle $\alpha$ is determined by the just required printing pressure in the basic printing position and just still permissible printing pressure between plate cylinder 3 and blanket cylinder 2 respectively between the bearer rings.

After reaching the maximum printing pressure with the axes 7, 8, and 9 being on the straight-line $g_1'$, the axis 8 and with it the blanket cylinder 2 can still be swiveled clockwise by the adjustment angle $\alpha'$. The adjustment angle $\alpha'$ is established by the straight-line $g_3'$. Adjustment angle $\alpha'$ and the straight-line $g_3'$ are mirrored symmetrically to the straight-line $g_1'$. The printing pressure between plate cylinder 3 and blanket cylinder 2 is decreased from the maximum value to the minimal value by swiveling of the blanket cylinder 2 with adjustment angle $\alpha$. The minimal printing pressure is reached when the axis 8 is on the straight-line $g_3'$. This value corresponds to the basic printing position. Therefore the blanket cylinder 2 can be moved within the adjustment angle range $\beta$, which is the sum of the adjustment angles $\alpha$, $\alpha'$ without any required tracking of the plate cylinder 3.

We claim:

1. Apparatus for setting printing pressure in an offset printing press having an impression cylinder, an eccentrically journaled blanket cylinder, and an eccentrically journaled plate cylinder, each of said cylinders and each of said eccentric journals having an axis, wherein the printing pressure is to be adjusted between said blanket cylinder and said impression cylinder, as well as between said blanket cylinder and said plate cylinder, wherein a bearer-ring-to-bearer-ring contact exists between the blanket cylinder and the plate cylinder, comprising (a) the impression cylinder, the blanket cylinder and the plate cylinder having (i) a first printing position wherein said axis of said plate cylinder and said axis of said eccentric journal of said blanket cylinder are disposed on a first straight line, and wherein said axis of said blanket cylinder is disposed on a second straight-line intersecting with said first straight-line at said axis of said eccentric journal of said blanket cylinder, said first and said second straight lines defining a first adjustment angle therebetween, (ii) a second printing position wherein said axis of said plate cylinder, said axis of said blanket cylinder and said axis of said eccentric journal of said blanket cylinder are disposed on said first straight line, and (iii) a third printing position wherein said axis of said plate cylinder and said axis of said eccentric journal of said blanket cylinder are disposed on said first line, and wherein said axis of said blanket cylinder is disposed on a third straight line intersecting with said first straight line at said axis of said eccentric journal of said blanket cylinder, said third line being on an opposite side of said first line with respect to said second line, said first and third lines defining a second adjustment angle therebetween, said second adjustment angle being substantially equal to said first adjustment angle, and (b) said blanket cylinder being movable from said first printing position through said second printing position to said third printing position without a corresponding synchronous adjustment of the plate cylinder about the eccentric journal thereof and without regard to the rotational position of the plate cylinder about the axis thereof.

2. The apparatus of claim 1, wherein the size of said first and second adjustment angles are determined by the maximum possible printing pressure between blanket cylinder and plate cylinder.

3. The apparatus of claim 1, wherein the size of said first and second adjustment angles are determined by the maximum possible printing pressure between bearer rings of said blanket cylinder and said plate cylinder.

* * * * *